US006615983B1

(12) United States Patent
Yu

(10) Patent No.: US 6,615,983 B1
(45) Date of Patent: Sep. 9, 2003

(54) TOOL KIT

(76) Inventor: Hong Chao Yu, P.O. Box 2103, Taichung (TW)

( * ) Notice: Subject to any disclaimer, the term of this patent is extended or adjusted under 35 U.S.C. 154(b) by 0 days.

(21) Appl. No.: 10/189,827

(22) Filed: Jul. 8, 2002

(51) Int. Cl.[7] ..... B65D 85/28
(52) U.S. Cl. ..... 206/372; 206/378; 206/379
(58) Field of Search ..... 206/349, 372, 206/375–379, 817; 211/70.6

(56) References Cited

U.S. PATENT DOCUMENTS 5,190,154 A * 3/1993 Reusch ..... 206/375
5,535,882 A * 7/1996 Liu ..... 206/376
6,050,409 A * 4/2000 Delbeck et al. ..... 206/379

* cited by examiner

*Primary Examiner*—Luan K. Bui

(57) ABSTRACT

A tool kit including a seat body and an upper lid pivotally connected with the seat body. The seat body is formed with multiple receiving holes for accommodating therein screw-driver bits or sockets. One side of each receiving hole is formed with a guide slot communicating with the receiving hole. The bottom of the upper lid is formed with multiple push arms corresponding to the guide slots. When the upper lid is pivoted, the push arms are pivotally rotated within the guide slots. When the upper lid is closed onto the seat body, the front ends of the push arms are rotated to the bottoms of the receiving holes. When the upper lid is opened, the front ends of the push arms are rotated into the middle sections of the receiving holes.

4 Claims, 6 Drawing Sheets

TOOL KIT

A present invention is related to a tool kit for accommodating therein screwdriver bits or sockets. A user can conveniently take out the screwdriver bits or sockets for use.

FIG. 11 shows a conventional screwdriver bit holder having an elongated seat body 5 made of plastic material. The seat body is formed with multiple receiving holes 51 for accommodating therein multiple screwdriver bits 6.

In order to securely insert the screwdriver bits 6 in the receiving holes 51, the diameter of the receiving holes 51 is slightly smaller than the diameter of the screwdriver bits 6. The plastic-made seat body 5 is flexible so that the screwdriver bits 6 can be fixedly inserted in the receiving holes 51. However, it is hard for a user to extract the screwdriver bits 6 out of the receiving holes 51 with single hand. It is necessary for the user to take out the screwdriver bits 6 with both hands. Therefore, it is inconvenient to use such screwdriver bit holder.

In the case that the receiving holes 51 are designed with larger diameter, it will be easier to take out the screwdriver bits 6. However, the screwdriver bits 6 tend to unexpectedly drop out and miss.

SUMMARY OF THE INVENTION

It is therefore a primary object of the present invention to provide a tool kit including a seat body and an upper lid pivotally connected with the seat body. The seat body is formed with multiple receiving holes for accommodating therein screwdriver bits or sockets. The bottom of the upper lid is formed with multiple push arms corresponding to the receiving holes. When the upper lid is pivotally opened, the front ends of the push arms are rotated into the middle sections of the receiving holes to lift the screwdriver bits or sockets out of the upper ends of the receiving holes. At this time, a user can conveniently take out the screwdriver bits or sockets for use. When the upper lid is closed onto the seat body, the front ends of the push arms are rotated to the bottoms of the receiving holes. At this time, the screwdriver bits or sockets will fall into the receiving holes due to their own weight and are totally accommodated in the receiving holes.

The present invention can be best understood through the following description and accompanying drawings wherein:

DETAILED DESCRIPTION OF THE PREFERRED EMBODIMENTS

Figure 1:
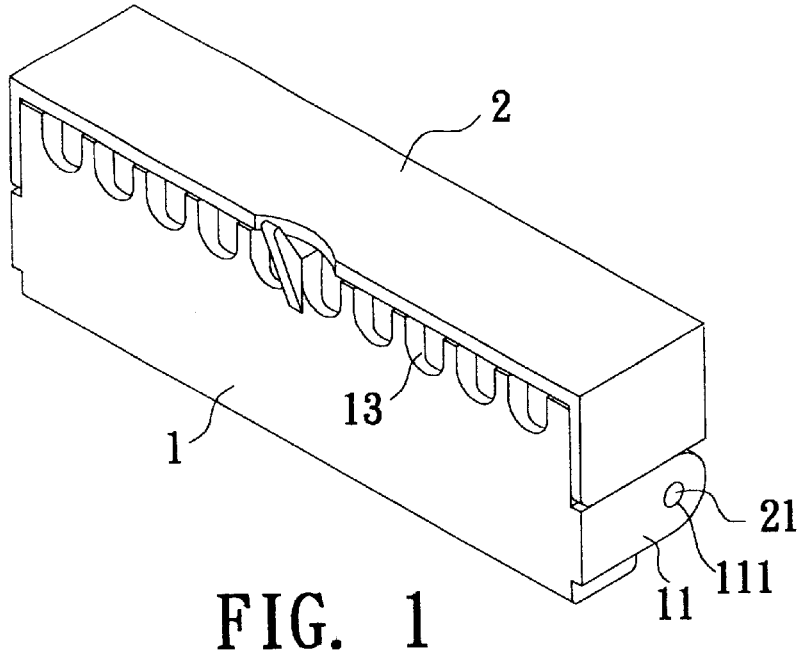
FIG. 1 is a perspective assembled view of a first embodiment of the present invention.
Figure 2:
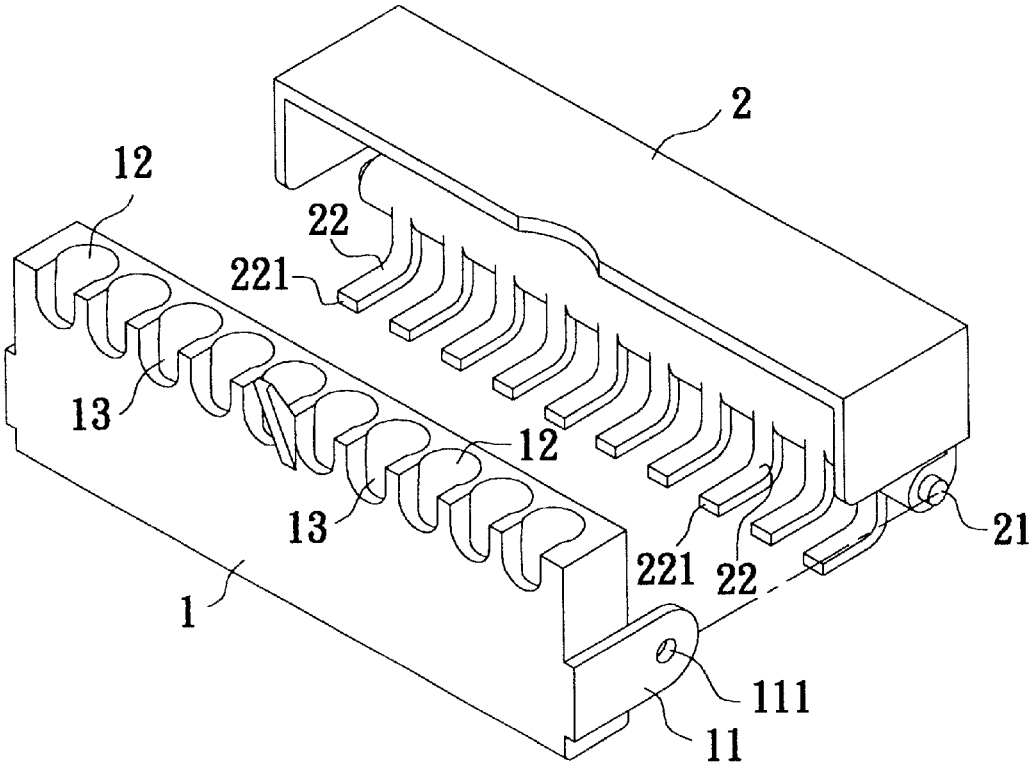
FIG. 2 is a perspective exploded view of the first embodiment of the present invention.
Figure 3:
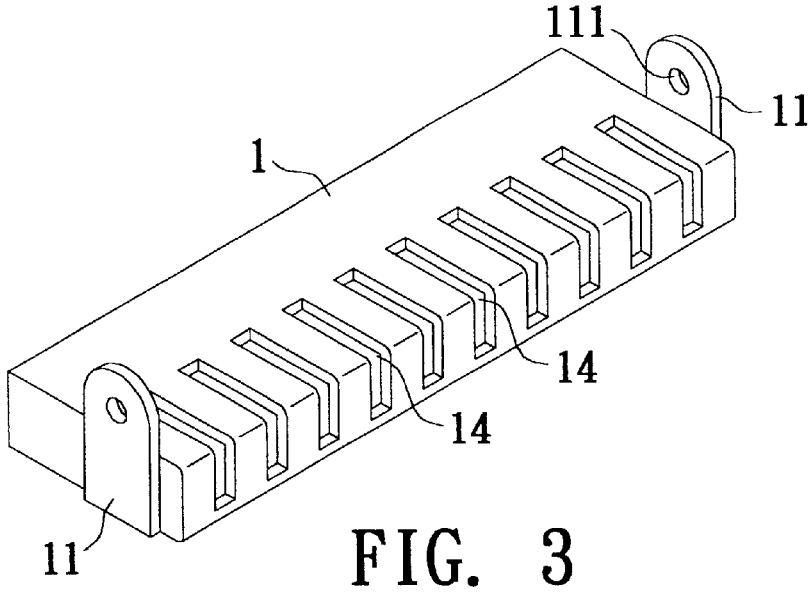
FIG. 3 is a perspective view of the seat body of the first embodiment of the present invention seen in another direction.

Please refer to FIGS. 1 to 3. According to a first embodiment, the tool kit of the present invention includes a seat body 1 and an upper lid 2.

Two sides of the seat body 1 are respectively formed with two rearward extending pivot seats 11 each having a pivot hole 111 for pivotally connecting with the upper lid 2. The seat body 1 is formed with multiple receiving holes 12 sequentially arranged on the seat body 1. Each receiving hole 12 is for accommodating therein a screwdriver bit 3. The depth of the receiving hole 12 is approximately equal to the length of the screwdriver bit 3. One side of top end of each receiving hole 12 is formed with an observation window 13 for a user to see the pattern of the screwdriver bit 3 accommodated in the receiving hole 12. Each receiving hole 12 has a guide slot 14 passing through a bottom and a lateral side of the seat body 1.

The upper lid 2 can be opened or closed to mate with the seat body 1. Two ends of bottom section of the upper lid 2 are respectively formed with two shaft rods 21 for pivotally connecting with the pivot holes 111 of the pivot seats 11. Accordingly, the upper lid 2 can be pivotally opened or closed on the seat body 1. The bottom of the upper lid is formed with multiple push arms 22 corresponding to the guide slots 14. A front end 221 of the push arm 22 extends through the guide slot 14 to the bottom of the receiving hole. The push arms 22 are pivotally rotated along with the upper lid 1 in a certain path through the guide slots 14. When the upper lid 2 is closed onto the seat body 1, the front ends 221 of the push arms 22 are rotated to the bottoms of the receiving holes 12. When the upper lid 2 is opened, the front ends 221 of the push arms 22 are rotated into the middle sections of the receiving holes 12.

Figure 4:
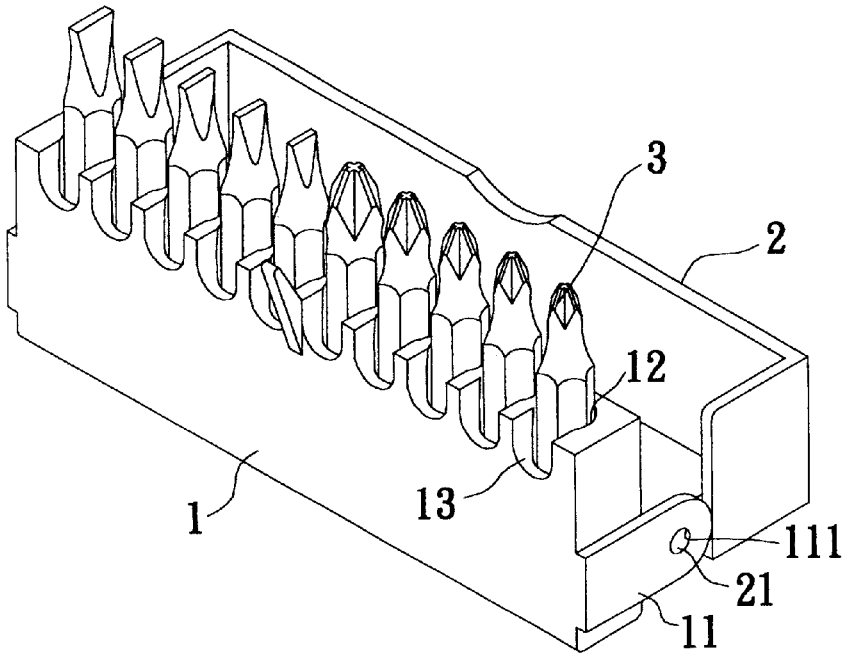
FIG. 4 shows that screwdriver bits are accommodated in the first embodiment of the present invention.
Figure 5:
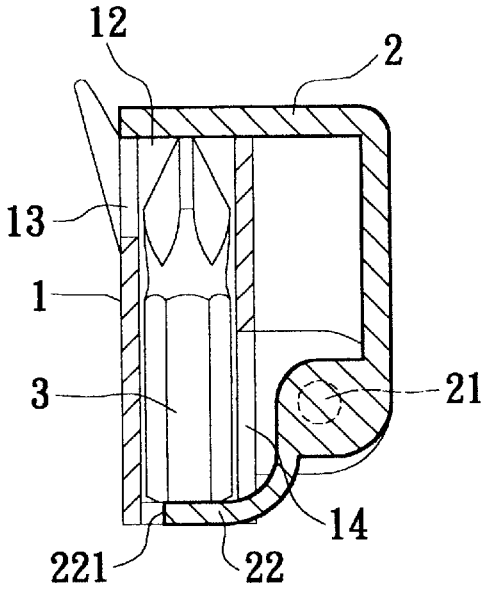
FIG. 5 is a sectional view showing that the screwdriver bits are totally accommodated in the first embodiment of the present invention.

Referring to FIGS. 4 and 5, multiple screwdriver bits 3 are respectively accommodated in the receiving holes 12. When the upper lid 2 is closed onto the seat body 1, the push arms 22 are pivotally rotated along with the upper lid 1 into the bottoms of the receiving holes 12. At this time, the screwdriver bits 3 will fall due to their own weight and are totally accommodated in the receiving holes 12. In addition, the upper lid 2 serves to stop the screwdriver bits 3 from dropping out of the receiving holes 12.

Figure 6:
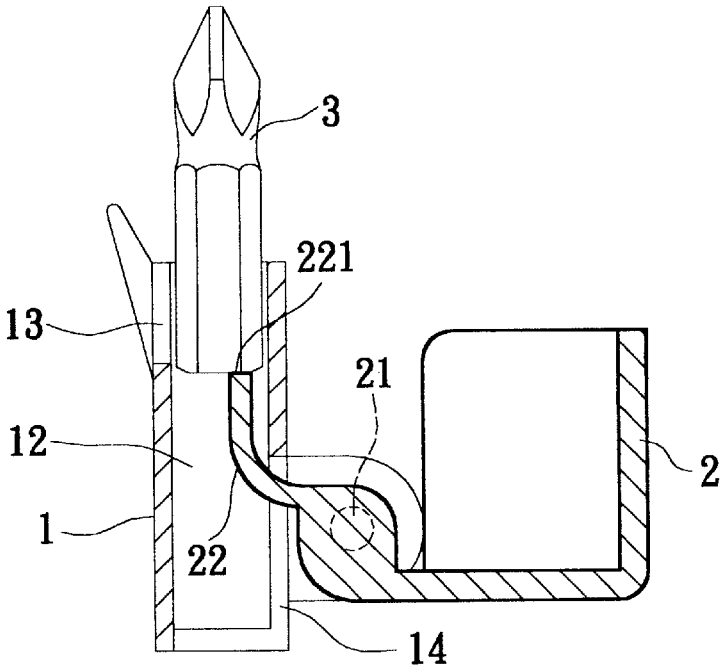
FIG. 6 is a sectional view showing that the screwdriver bits are lifted out of the receiving holes of the first embodiment of the present invention.

Referring to FIG. 6, when using the screwdriver bits 3, the upper lid 2 is pivoted and opened. At this time, the push arms 22 are rotated within the guide slots 14 and the front ends 221 are moved to the middle sections of the receiving holes 12 to lift the screwdriver bits 3. Under such circumstance, the upper sections of the screwdriver bits 3 are protruded from the receiving holes 12 and exposed to outer side for a user to conveniently take and use.

Figure 7:
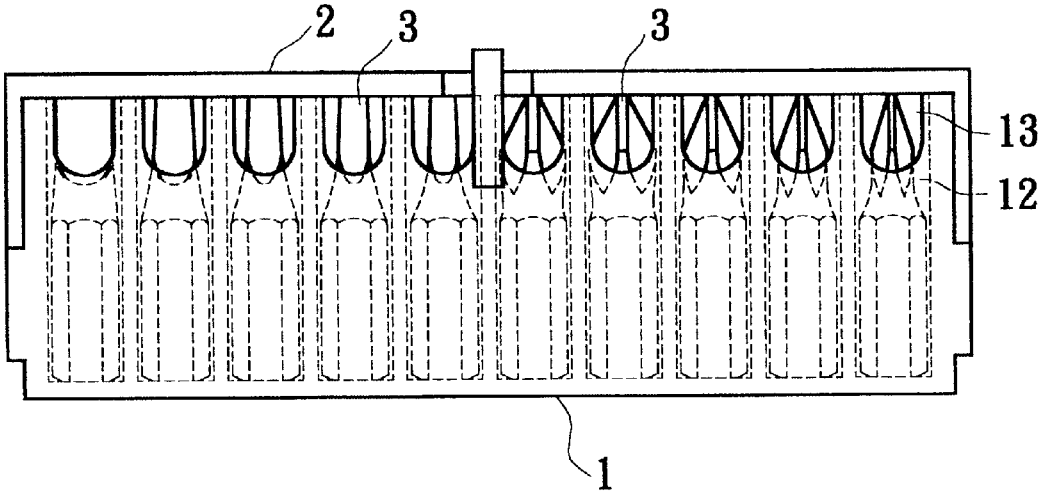
FIG. 7 shows that the patterns of the screwdriver bits are seen through the observation windows of the first embodiment of the present invention.

Referring to FIG. 7, through the observation windows 13 of the seat body 1, without opening the upper lid 2, a user can clearly see the patterns of the accommodated screwdriver bits 3 and more conveniently select the necessary screwdriver bits 3.

Figure 8:
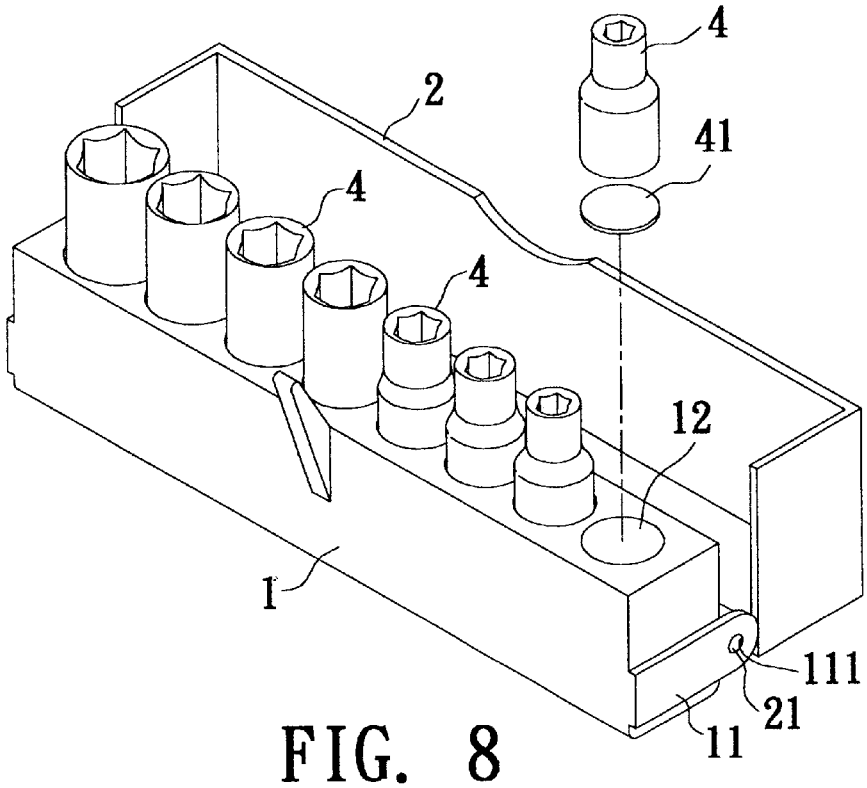
FIG. 8 is a perspective assembled view of a second embodiment of the present invention.

FIG. 8 shows a second embodiment of the present invention, in which the diameter of the receiving holes 12 is enlarged for receiving therein sockets 4. The depth of the receiving hole 12 is approximately equal to the length of.the sockets 4.

Figure 9:
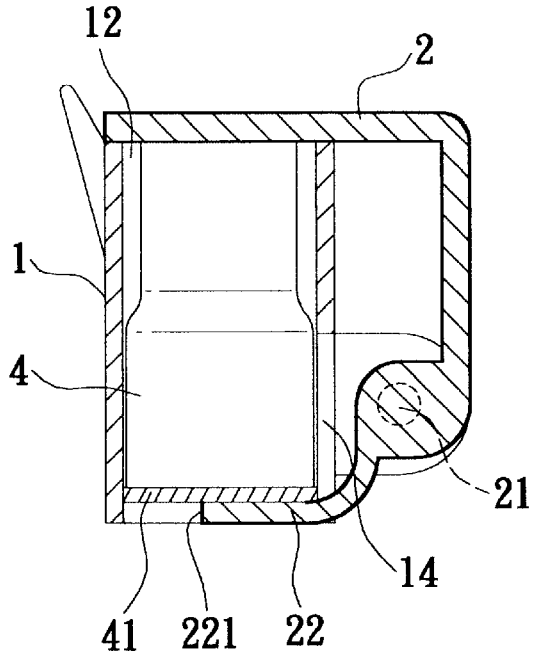
FIG. 9 is a sectional view showing that the sockets are totally accommodated in the second embodiment of the present invention.

Referring to FIG. 9, multiple sockets 4 are respectively accommodated in the receiving holes 12. Before placing in the socket 4, a pad member 41 is first placed into the receiving hole and then the socket 4 is rested on the pad member 41. When the upper lid 2 is closed onto the seat body 1, the push arms 22 are pivotally rotated along with the upper lid 1 into the bottoms of the receiving holes 12. At this time, the sockets 4 will fall due to their own weight and are totally accommodated in the receiving holes 12. In addition, the upper lid 2 serves to stop the sockets 4 from dropping out of the receiving holes 12.

Figure 10:
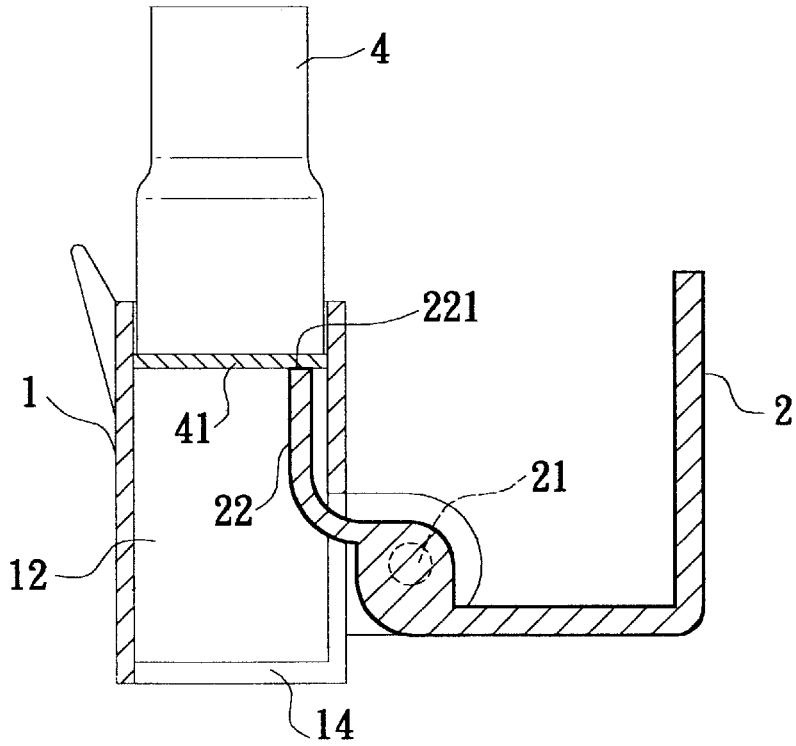
FIG. 10 is a sectional view showing that the sockets are lifted out of the receiving holes of the second embodiment of the present invention.
Figure 11:
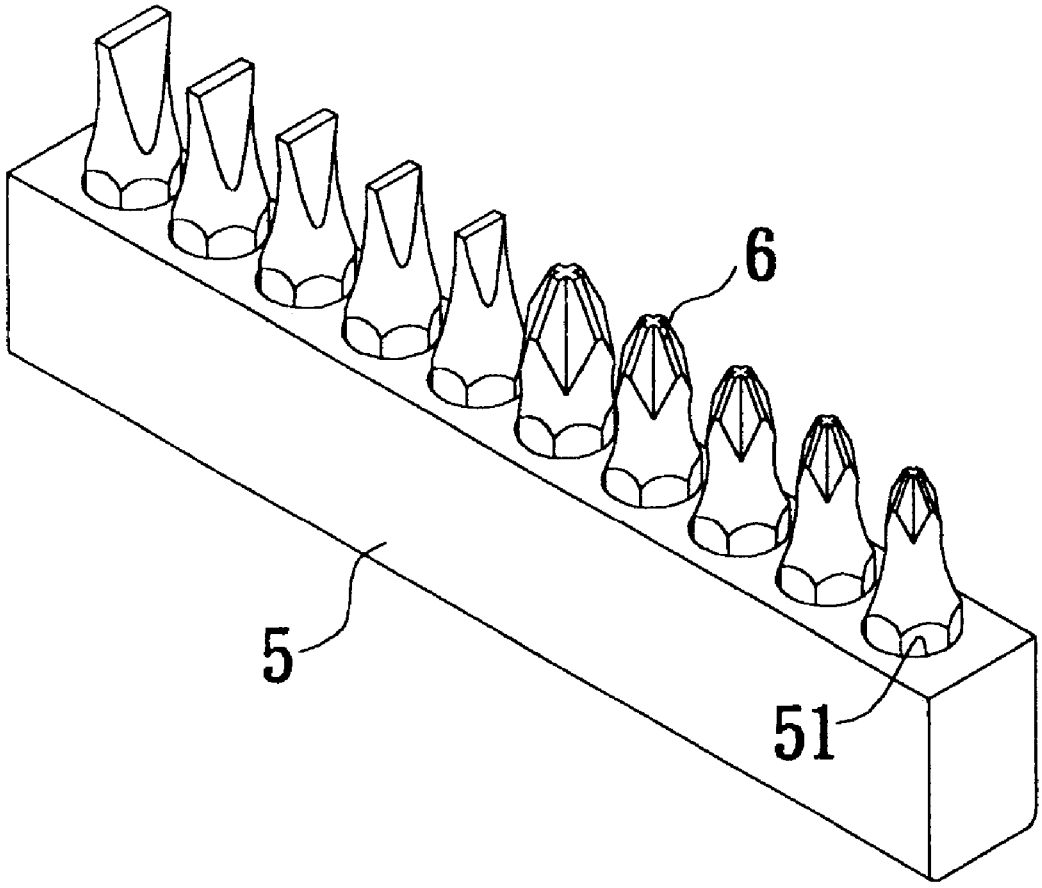
FIG. 11 PRIOR ART
FIG. 11 is a perspective view of a conventional screwdriver bit holder.

Referring to FIG. 10, when using the sockets 4, the upper lid 2 is pivoted and opened. At this time, the push arms 22 are rotated within the guide slots 14 and the front ends 221 are moved to the middle sections of the receiving holes 12 to lift the sockets 4. The pad members 41 prevent the push arms 22 from sinking into the insertion holes of the bottoms of the sockets 4. Accordingly, the upper sections of the sockets 4 are protruded from the receiving holes 12 and exposed to outer side for a user to conveniently take and use.

The above embodiments are only used to illustrate the present invention, not intended to limit the scope thereof. Many modifications of the above embodiments can be made without departing from the spirit of the present invention.

What is claimed is:

1. A tool kit comprising a seat body and an upper lid pivotally connected with the seat body, the upper lid being openable/closable on the seat body, the seat body being formed with multiple receiving holes sequentially arranged thereon, a bottom of the upper lid being formed with multiple push arms respectively corresponding to the receiving holes, one side of the seat body facing the push arms being formed with multiple guide slots communicating with the receiving holes, whereby the push arms can be pivotally rotated within the guide slots in a certain path to make front ends of the push arms extend through the guide slots to the bottoms of the receiving holes.

2. The tool kit as claimed in claim 1, wherein two ends of bottom section of the upper lid are respectively formed with two shaft rods, two ends of the seat body being respectively formed with two pivot seats corresponding to the shaft rods, each pivot seat having a pivot hole for pivotally connecting with the shaft rods, whereby the upper lid can be pivotally opened or closed on the seat body.

3. The tool kit as claimed in claim 1, wherein each receiving hole is for accommodating therein a screwdriver bit, the depth of the receiving hole being approximately equal to the length of the screwdriver bit.

4. The tool kit as claimed in claim 1, wherein each receiving hole is for accommodating therein a socket, the depth of the receiving hole being approximately equal to the length of the socket.

* * * * *